US005370268A

United States Patent [19]

Adams

[11] Patent Number: 5,370,268

[45] Date of Patent: Dec. 6, 1994

[54] REMOTELY OPERATED DRUM PUNCH

[76] Inventor: George R. Adams, 1227 Hudson Hills Dr., Ferguson, Mo. 63135

[21] Appl. No.: 167,402

[22] Filed: Dec. 14, 1993

Related U.S. Application Data

[63] Continuation-in-part of Ser. No. 925,784, Aug. 7, 1992, abandoned.

[51] Int. Cl.[5] ..... B67D 5/00

[52] U.S. Cl. ..... 222/1; 222/83.5; 294/115; 414/412

[58] Field of Search ..... 222/82, 83, 83.5, 88, 222/1; 141/51, 329, 330, 65; 294/106, 115; 414/411, 412

[56] References Cited

U.S. PATENT DOCUMENTS

| | | | |
|---|---|---|---|
| 2,356,440 | 8/1944 | Baumgard | 222/88 X |
| 2,622,767 | 12/1952 | Kovalik et al. | 222/83.5 |
| 2,722,210 | 11/1955 | Koonce | 222/83.5 X |
| 3,147,887 | 9/1964 | Brooks | 222/83.5 |
| 3,370,752 | 2/1968 | Abler | 222/83.5 |
| 3,385,475 | 5/1968 | Loe | 222/835 |
| 3,451,711 | 6/1969 | Carpenter | 294/115 X |
| 3,582,128 | 6/1971 | Martelee | 294/115 |
| 3,739,471 | 6/1973 | Peres | 414/412 X |
| 3,926,340 | 12/1975 | Tygenhof | 222/83.5 |
| 4,304,433 | 12/1981 | Langowski | 294/115 X |
| 4,349,054 | 9/1982 | Chipman | 141/330 X |
| 4,500,015 | 2/1985 | Penney | 222/83.5 |
| 4,690,180 | 9/1987 | Gold | 222/83.5 X |
| 4,735,368 | 4/1988 | Janko et al. | 414/412 X |
| 4,945,955 | 8/1990 | Murphy | 141/65 |
| 5,047,011 | 9/1991 | Caron et al. | 141/330 X |

FOREIGN PATENT DOCUMENTS

| | | | |
|---|---|---|---|
| 0405687 | 1/1991 | European Pat. Off. | 414/412 |
| 2619800 | 3/1989 | France | 294/115 |
| 361936 | 2/1973 | U.S.S.R. | 414/412 |
| 1406113 | 6/1988 | U.S.S.R. | 294/115 |

*Primary Examiner*—Kevin P. Shaver

*Attorney, Agent, or Firm*—Rogers, Howell & Haferkamp

[57] ABSTRACT

A remotely operable drum punch for puncturing a drum or container containing hazardous waste, chemicals, or acid consists of a drive which drives a punch head and self-admixing arms for securing the drum punch to the drum. The drive is remotely operable to drive both the self-affixing arms and the punch head so that the drum punch may be secured to the drum from afar. The punch head includes a collar, which may be movable, to form a seal with the top of the drum. The punch head also includes bores to allow the sampling, testing and exhausting of the drum's contents or to introduce agents, such as neutralizing or foaming or gelling agents, into the drum to neutralize or solidify the drum's contents. Inert gases can also be introduced into the drum.

23 Claims, 9 Drawing Sheets

REMOTELY OPERATED DRUM PUNCH

CONTINUING APPLICATION DATA

This application is a continuation-in-part of application Ser. No. 925,784 filed Aug. 7, 1992, now abandoned.

BACKGROUND OF THE INVENTION

This invention relates to drum punches, and, specifically to a drum punch which may be remotely operated.

Hazardous waste drums have been deposited in a large number of hazardous waste sites across the United States. Drums have also been abandoned in fields, buildings and by the sides of roads. These drums corrode over time and, if not emptied before they corrode, will leak their contents to the surrounding area. The drum's contents often are not marked, or the label is unreadable. In the process of cleaning up waste sites, disposal companies therefore must first puncture the sealed drums and test the contents to determine their composition.

The drum contents are often under pressure and may therefore explode upon puncturing, spreading the contents of the drum and pieces of the drum over the surrounding area. If the drum does not explode, the pressurized contents could still be spewed out over the surrounding area and on nearby workers. The process of puncturing the drum therefore can be dangerous. In one drum punching process, an individual pierces the drum using a hammer and hand-held punch. This process has proven undesirable, as explosions from the drums have killed or maimed a number of people. In another method, drums have been pierced using the toothed scoop of a back hoe. However, this method often results in the back hoe being sprayed with hazardous wastes, necessitating additional expensive cleanup.

In another process, a puncturing device is set on top of the drum and then attached to the drum by workers using a turnbuckle device or hand screws. This method also exposes workers to danger. The drums can be so highly pressurized or corroded that the process of affixing the device to the drum can result in explosion or the spewing of hazardous waste, chemicals, or acids over the surrounding area and on nearby workers. In another method, the drum is shot from a distance with a rifle or high-powered cross bow. This method, like the back hoe method, often results in the contents of the drum then leaking onto the ground, increasing cleanup costs.

Other devices, such as shown in U.S. Pat. No. 4,690,180 to Gold, or European Patent Application 405,685 A1 to Oskam, provide devices which surround the drum to be punctured and emptied. The Oskam application, for example, provides a bell which surrounds the drum and is filled with a low oxygen environment. Such a device is expensive to build and operate. These devices require that the drum be moved to the drum puncturing machine. If a drum is severly corroded, it may not be able to be moved without endangering the workers.

SUMMARY OF THE INVENTION

One object of the present invention is to provide a drum punch which may be remotely operated.

Another object is to provide such a drum punch which will reduce the risk of death and injury to drum punch operators.

Another object is to provide such a drum punch which reduces the possibility of spreading hazardous waste when the drum is punched.

Another object is to provide such a drum punch which allows for testing of the drum's contents.

Another object is to provide such a drum punch which allows for evacuation of the drum's contents or treatment of the contents within the drum.

Another object is to provide such a drum punch which is self-affixing.

Another object is to provide such a drum punch which may be used with drums or containers of different sizes and conditions, including bulged drums.

Another object is to provide such a drum punch which may be used to punch drums containing both liquids and gases.

Another object is to provide such a drum punch which may be transported to waste drums and connected thereto, rather than the drum being transported to the drum punch.

Another object is to provide such a drum punch which is economical to produce and simple to operate.

Further objects and advantages of my invention will become apparent to those skilled in the art in light of the following disclosure and accompanying drawings.

In accordance with the invention, briefly stated, a drum punch of the present invention includes a base which sits upon the drum, a remotely operable drive mounted to the base, a rod operably connected to the drive to be driven thereby, a punch head mounted to an end of the rod to be moved vertically when the drive means is operated to pierce a top of the drum, and remotely operable gripping means which are operatively connected to the drive for securing the drum punch to the drum. The drive is preferably a pneumatic or hydraulic cylinder, but may also be an electric motor. If a motor is used, the rod may be a threaded rod which is connected to the output shaft of the motor to be rotated by the motor. The motor may alternatively drive a gear having an internally threaded bore through which the threaded rod is journaled.

The punch head includes a collar having a seal which seals the top of the drum when the punch pierces through the drum top. Preferably, the seal is made of a deformable material. The collar may be journaled on the punch head so that it can move relative to the punch head. This allows the punch head to be inserted into the drum a desired distance without the collar acting as a stop. The punch head also includes at least one bore having one opening positioned below the collar and a second opening positioned above the collar. The bore allows for depressurization of the drum and, if connected to a sampler, for analyzing the contents of the drum with the drum punch in place on the drum. The bore also allows for treatment of the drum contents in situ and for collecting of the drum contents. The punch head may include two bores, one of which is connected to treating equipment and the other of which is connected to the sampling and collecting equipment. This will allow for both the treating and sampling of the drum contents without having to change equipment at a remote end of a hose or to change hoses at the drum head. The contents of the drum may be treated with neutralizing agents to neutralize the drum contents or solidifying agents to gel the drum contents.

In one embodiment of the drum punch, the drum punch includes an upwardly extending slide to which the drive is mounted, a stop on the slide to limit upward movement of the drive, and at least one downwardly extending strut. The remotely operable gripping means includes a pivot arm pivotally secured at a first end thereof to a bottom of the strut, a clamp arm pivotally secured at a first end thereof to a second end of the pivot arm remote from the pivot arm first end, and a base arm extending horizontally along the base. A drum clamp pad is mounted to the clamp arm at a second end thereof. The clamp arm is pivotally connected to the horizontal arm between the clamp pad and the pivot arm. When the cylinder is moved upwardly, the clamp pad is moved inwardly to contact a side of the drum to secure the drum punch to the drum. Preferably, the punch includes two such clamp pads spaced 180° from each other.

In a second embodiment, the drive is mounted to a generally vertical support and the base includes a horizontal arm extending outwardly from the vertical support. The gripping means includes an inwardly directed upper gripping pad mounted to an end of the horizontal arm, and a generally C-shaped clamp mounted to the horizontal arm near the end of the horizontal arm. The C-shaped clamp includes an inwardly directed lower gripping pad which contacts a side of the drum and an upper grip which contacts an inner surface of a rim of the drum. The upward motion of the drive pivots the clamp about the upper gripping pad to bring the lower gripping pad into contact with the drum side and the upper rim grip into contact with the drum rim.

The operation of the drum punch includes placing the drum punch on the drum and remotely operating the drum punch to move the punch head until the punch head is in contact with the top of the drum. After the punch head is in contact with the drum, the grips are remotely operated to secure the drum punch to the drum. The punch head is then further remotely operated to pierce the top of the drum. When the drum top is pierced, the hole formed is sealed. The drum punch is transportable and is moved to the drum, rather than the drum being moved to the drum punch. This eliminates the danger inherent in moving severly corroded drums. Only after the drum contents have been neutralized or determined to be safe, is the drum moved.

BRIEF DESCRIPTION OF THE DRAWINGS

Similar reference numerals indicate similar parts throughout the several views of the drawings.

DESCRIPTION OF THE PREFERRED EMBODIMENT

Figure 1:
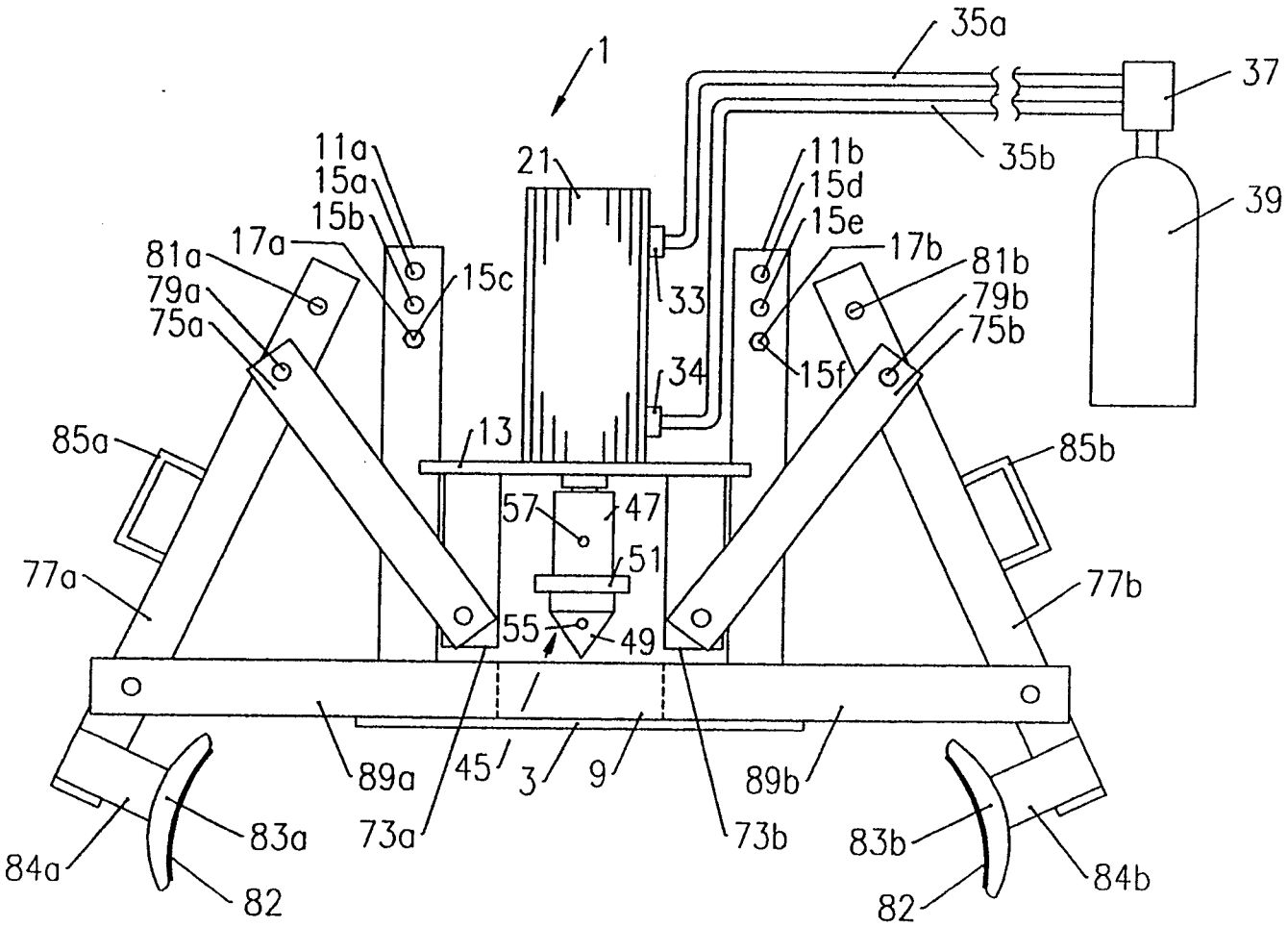
FIG. 1 is a side elevational view of a drum punch of the present invention.

One illustrative embodiment of a drum punch 1 of the present invention is shown in FIG. 1 which can be used to punch a drum containing hazardous waste, chemicals or acids. Although the punch 1 is described for use with respect to drums, it will be apparent to those skilled in the art that it may also be used with other containers and cylinders. It will also be apparent that the punch may be sized to be used with small drums or containers, such as five gallon drums, or large drums, such as fifty-five gallon drums, or larger.

Figure 2:
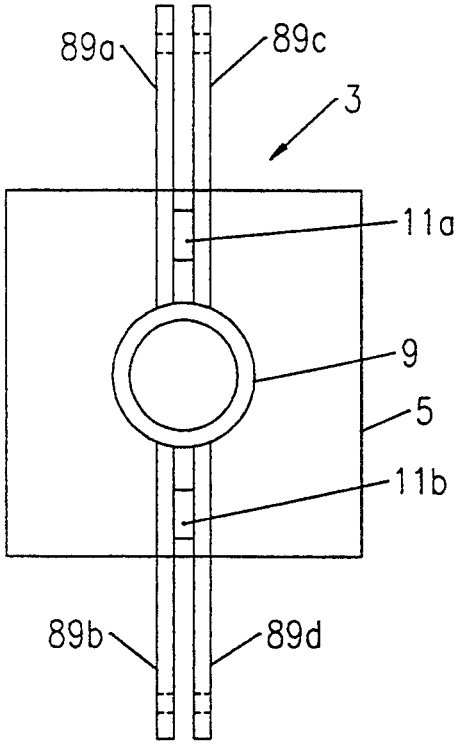
FIG. 2 is a top plan view of a base of the drum punch.

Punch 1 includes a base 3. Base 3 includes a spray guard 5 (FIG. 2) which is sized to rest upon a drum 7, as shown in FIGS. 8–11. A centrally disposed opening 9 is formed in base 3. Opening 9 is sized to allow the drum punch 1 to balance on the top of the drum if the top is bulged upwardly by internal pressure.

Figure 3:
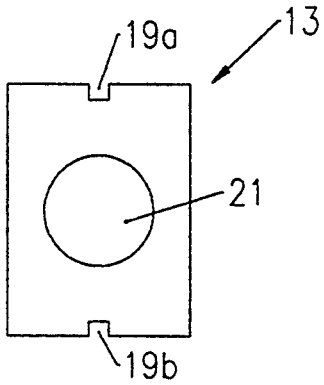
FIG. 3 is a top plan view of a platform of the drum punch.
Figure 5:
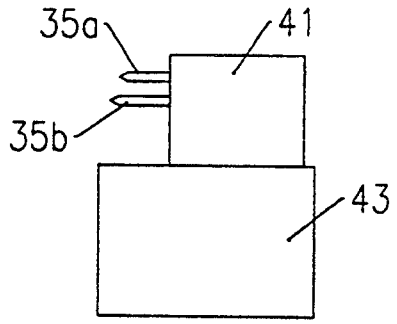
FIG. 5 is a schematic of a pneumatic oil system used to operate the drum punch.

A pair of oppositely disposed slides, **11*a* and 11*b*, are secured to base 3 on opposite sides of opening 9. A platform 13 is received between slides 11*a* and 11*b* for vertical movement. Platform 13 has a pair of notches or guides 19*a* and 19*b* (FIG. 3) formed on opposite sides of the platform 13. Notches 19*a* and 19*b* are sized to received or surround slides 11*a* and 11*b* so that the platform 13 may move vertically with respect to the slides. Preferably, slides 11*a* and 11*b* have stops to limit the vertical movement of platform 13. Holes 15*a–f* are formed in slides 11*a* and 11*b*, two holes being formed in each slide. The holes in each slide are vertically spaced and receive bolts 17*a* and 17*b* which interfere with the upward motion of platform 13** to act as stops.

A pneumatic cylinder 21 is secured to a top of platform 13. Cylinder 21 has a piston 23 (FIG. 4) contained therein which divides the cylinder into upper 25 and lower 27 chambers. A piston rod 29 extends from piston 23 through the bottom of the cylinder and through platform 13. A piston guide 31 is formed on the bottom of platform 13 through which rod piston 29 extends. Cylinder 21 includes a top actuation and retraction air inlet port 33 and bottom actuation and retraction air inlet port 34. Pneumatic lines **35*a* and 35*b* (FIG. 1) are attached to actuation and retraction air inlet ports 33 and 34, respectively, to drive cylinder 21 so that piston rod 29 may be extended and retracted. The free ends of the pneumatic lines are attached to compressed gas regulator 37, which is attached to compressed gas tank 39, A hydraulic pump 41 with an oil resevoir 43** (FIG.

5) may be used in lieu of regulator 37 and tank 39. Regulator 37 and tank 39 (or pump 41 and reservoir 43) are positioned remotely from drum punch 1 so that punch 1 may be remotely operated. The distance between punch 1 and regulator 37 is a distance sufficient to ensure safety of the punch operator.

A punch head 45 (shown in detail in FIG. 4) is secured to the bottom of piston rod 29. Punch head 45 includes a punch body 47, puncturing point 49, and a sealing collar 51. Head 45 is preferably made of a non-sparking material, such as naval brass, to minimize the risk of igniting the drum contents. Punch body 47 includes a threaded bore 52 at its top so that the body may be removably secured to rod piston 29. This will allow for easy replacement or repair of the body. Punch 45 is preferably cylindrical, but may be make in any desired shape.

Punch head 45 has an exhaust bore 53 having an inlet 55 near the top of puncturing point 49 and a pair of oppositely disposed outlets 57 above collar 51. Exhaust outlets 57*a,b* are situated on opposite sides of punch body 47 and communicate with exhaust bore 53. Exhaust bore couplings 59*a* and 59*b* may be placed at outlets 57*a* and 57*b*. Couplings 59*a* and 59*b* may be quick connect couplings or threaded couplings. The couplings may then be equipped with different kinds of valves, check valves, and hoses 60 to connect bore 53 to various types of filters and testing equipment.

Figure 4:
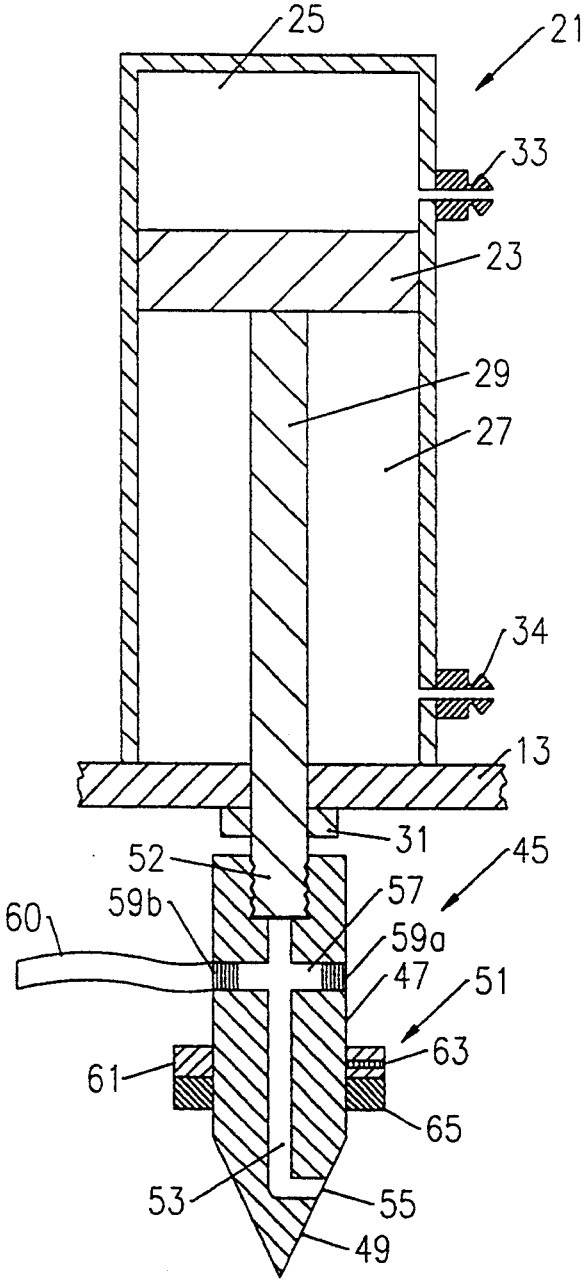
FIG. 4 is a cross-sectional view of a cylinder and punch head of the drum punch.
Figure 11:
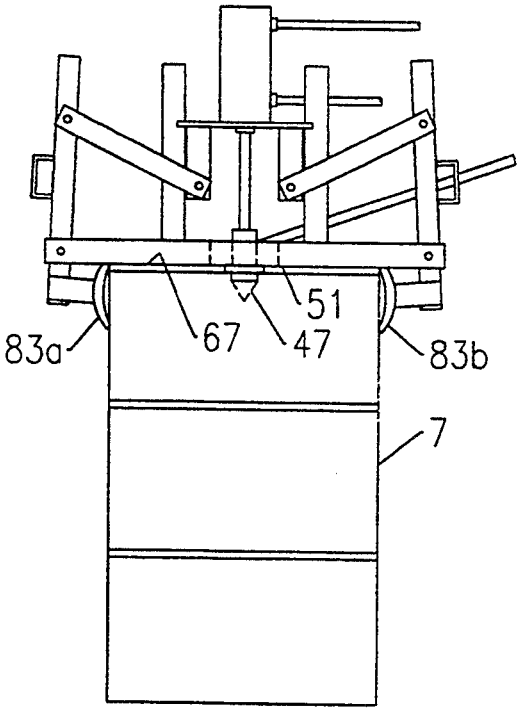
FIG. 11 is a side elevational view of the drum punch of FIG. 1, with the punch head inserted into the top of the drum.

Punch collar 51 includes a cylindrical base portion 61 having a radially extending set screw 63 to fix the collar to the punch head body 47. A deformable seal or gasket 65 is secured to the underside of collar base portion 61. Seal 65 seals against the top 67 of drum 7, as seen in FIG. 11, to substantially eliminate the spreading of the waste contained in the drum, as described below. The seal is preferably made of a material which is resistant to the contents of the drum. The collar shown in FIG. 4 is fixed to the punch head 45 by virtue of set screw 63. It will thus act as a stop, limiting the distance to which the drum head can be inserted into the drum through the drum top. The collar may alternatively be moveably mounted to the punch head body so that the punch head can be inserted into the drum a desired distance. If the collar is movable with respect to the punch head, it frictionally engages the punch head so that a seal with the drum top is maintained.

Figure 6C:
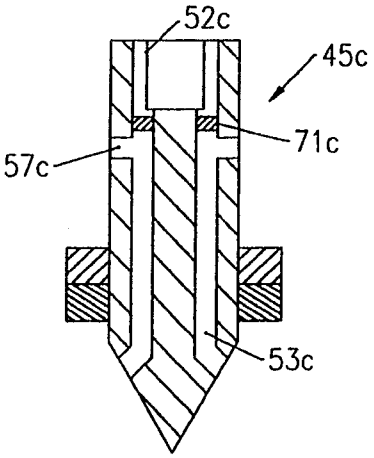
FIGS. 6A–6E are cross-sectional views showing alternative embodiments of the punch head.
Figure 6B:
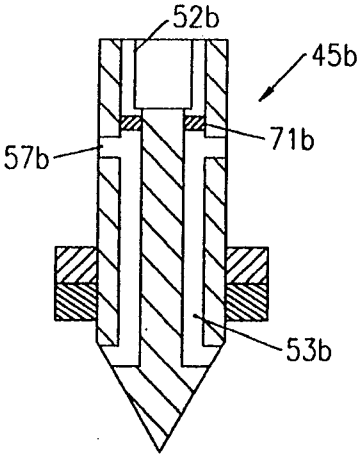
Figure 6A:
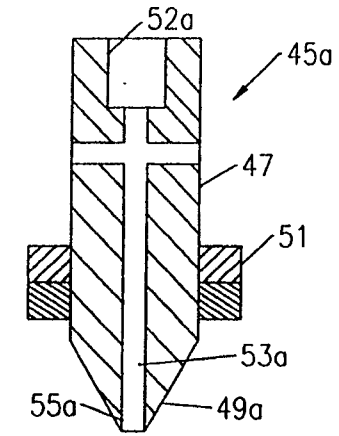
Figure 6E:
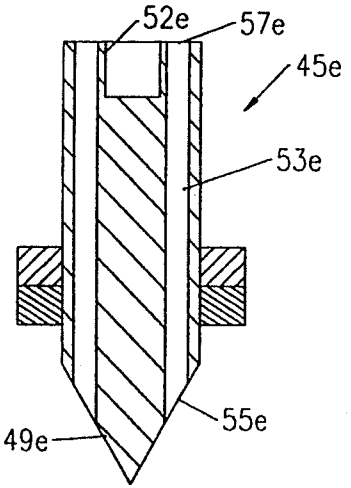
Figure 6D:
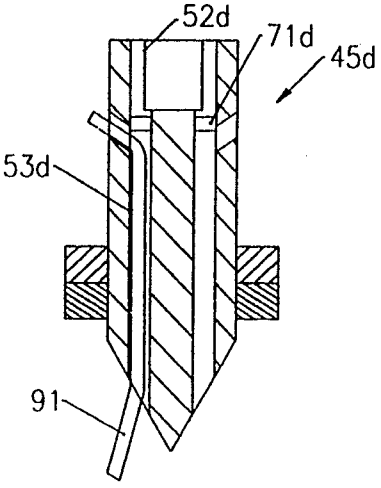

Variations of punch head 45 are shown in FIGS. 6A–6E. Head 45*a* is very similar to head 45, except that its exhaust bore 53*a* extends vertically down head 45*a* so that inlet 55*a* is located at the bottom of punch point 49*a*. In FIGS. 6B–6E, heads 45*b–45e* are provided with two identical bores 53*b–53e*. In heads 45*b–d*, the bores are formed by boring vertically through the head from threaded bore 52*b–d*. The bores 53*b–d* are then closed below bores 52*b–d* by a seals 71*b–d*. In FIG. 6E, the bores 53*e* extend vertically through the head so that openings 57*e* are located at the top of the head and inlets 55*e* are located along punch point 49*e*. The upper openings 57 may extend perpendicularly to bores 53, as shown in FIGS. 6B and 6C, or may extend diagonally upwardly from bore 53, as shown in FIG. 6D. Bottom inlets 55 may similarly extend generally horizontally from bore 53 (FIG. 6B) or extend diagonally from the bore (FIG. 6C).

Figure 7:
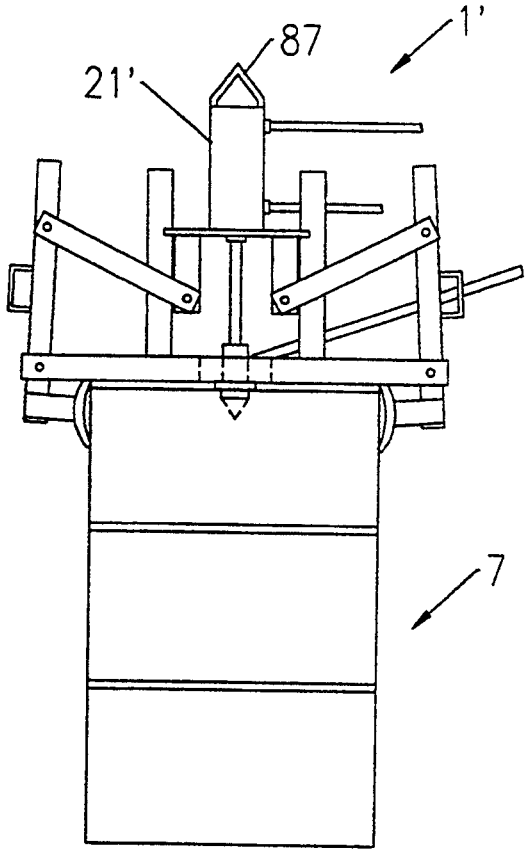
FIG. 7 is a side elevational view showing the drum punch mounted to a drum and having a lifting ring fixed thereto.
Figure 8:
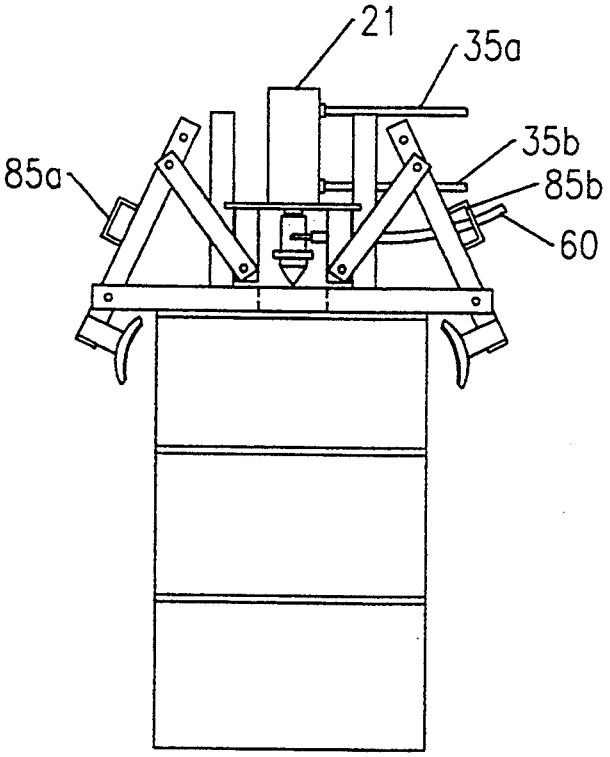
FIG. 8 is a side elevational view of the drum punch of FIG. 1 in place on a drum prior to operation of the drum punch.

Returning to FIG. 1, pivot struts 73*a* and 73*b* project downwardly from platform 13 on opposite sides thereof. Pivot arms 75*a* and 75*b* are pivotally secured to the bottom of struts 73*a* and 73*b*. Clamping arms 77*a* and 77*b* are pivotally secured to the ends of pivot arms 75*a* and 75*b* remote from struts 73*a* and 73*b*. Pivot pins 79*a* and 79*b* extend through holes formed in arms 75*a,b* and 77*a,b* to pivotally connect the arms. Additional pivot pin holes 81*a* and 81*b* may be provided on arms 75*a,b* or 77*a,b*. In FIG. 1, holes 81*a,b* are shown to be on clamp arms 77*a* and 77*b*. Generally arcuate drum clamps 83*a* and 83*b* are attached to clamping arms 77*a* and 77*b*. Preferably, clamps 83*a,b* are secured to the ends of ears 84*a,b* which extend perpendicularly to clamp arms 77*a,b* and inwardly towards drum 7. The base, platform, struts and arms of punch 1 are preferably made of a resistant, rigid material such as aluminum, steel, brass, or high density plastics. Other materials can be chosen. Clamps 83*a,b* are made of metal and have a rubber or teflon lining 82 which eliminates a metal-to-metal contact and provides for greater friction between the punch and the drum to create a better grip of the punch to the drum. Preferably, the lining is about ⅜" thick. Carrying handles 85*a* and 85*b* are situated on clamping arms 77*a* and 77*b*. In FIG. 7, drum punch 1' is provided with a lifting ring or projection 87 on the top of cylinder 21'.

A set of arms 89*a, b, c,* and *d* (FIGS. 1 and 2) extend along the top of spray guard 5 generally radially of hole 9. Arms 89*a–d* form two members made of spaced apart arms which surround slides 11*a* and 11*b*. One member includes arms 89*a* and 89*c* and the other arm includes arms 89*b* and 89*d*. Clamping arms 77*a* and 77*b* are pivotally pinned to arms 89*a–d* between clamps 83*a,b* and pins 79*a,b*. Preferably, arms 89*a–d* are connected to arms 77*a,b* close to clamps 83*a,b* so that the clamps will therefore be situated near the top of the drum, as seen in FIGS. 11–14. The length of the clamp arms 77*a,b* and the relative position of arms 89*a–d* with respect to arms 77*a,b* may be changed to alter the clamping position of clamps 83*a,b* on drum 7.

Figure 9:
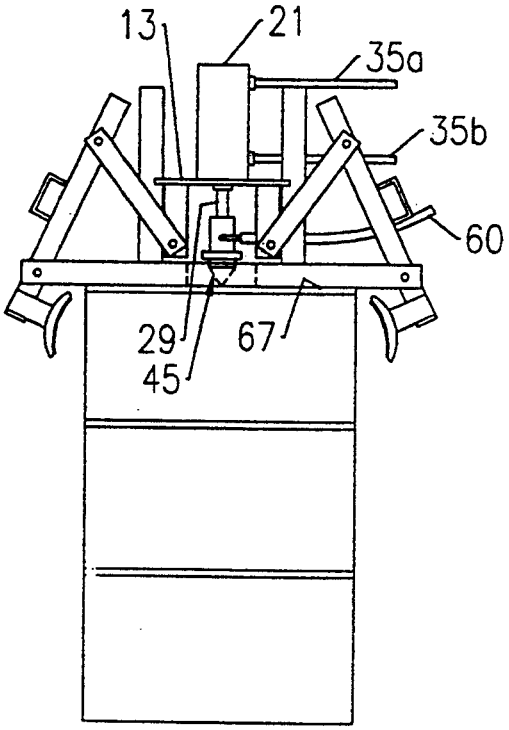
FIG. 9 is a side elevational view of the drum punch of FIG. 1, with the punch in contact with the top of the drum.

The operation of the drum punch 1 is shown in FIGS. 8–11. Using the handle 85*a,b* or ring 87 (FIG. 7), the punch 1 is placed on a drum 7 to rest thereon. The punch 1 at this point is not fixed to the drum. Regulator 37 is then operated remotely from drum punch 1 to force compressed gas into top actuation and retraction air inlet port 33 into upper pneumatic chamber 25, forcing piston rod 29 and punch head 45 downwardly. The downward motion of punch head 45 continues until puncturing point 49 comes into contact with top 67 of drum 7 (FIG. 9).

Because the cylinder is mounted on vertically movable platform 13, the vertical motion is transferred to cylinder body 21 and cylinder platform 13 when the punch head 45 initially contacts drum top 67. As piston 29 is further extended, cylinder 21 and platform 13 move upwardly in relation to base 3 until the platform contacts stops 17*a,b*. The upward movement of cylinder platform 13 in relation to the device base 3 raises the inner ends of pivot arms 75*a* and 75*b* which pushes the outer ends outward. This pushes the top of clamping arms 77*a* and 77*b* outward, bringing the clamps 83*a* and 83*b* inwardly to grip the sides of drum 7. (FIG. 10) Clamps 83*a,b* may have pads 82 attached to an inner or gripping surface thereof and which are made of a deformable non-sparking material to eliminate metal-to-metal contact.

Figure 10:
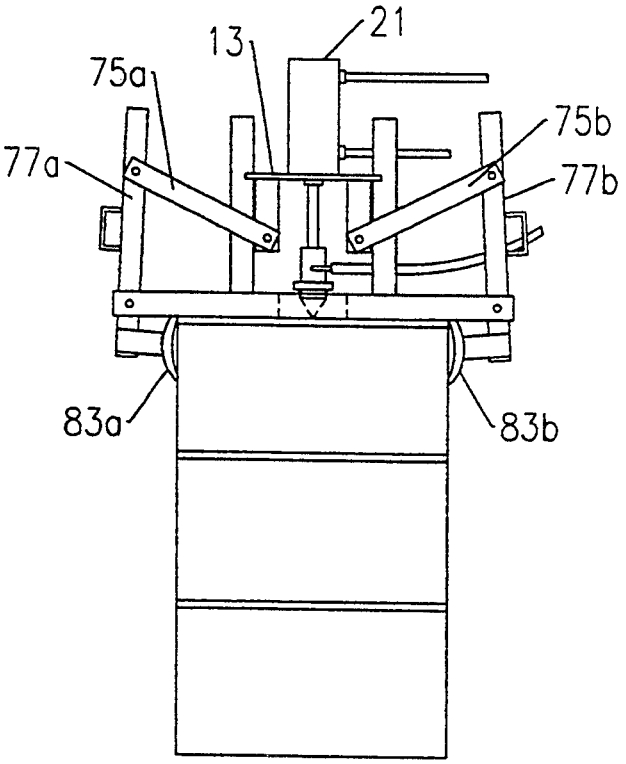
FIG. 10 is a side elevational view of the drum punch of FIG. 1 with the clamps in contact with the side of the drum to secure the drum punch to the drum.

When the drum clamps 83*a* and 83*b* come in contact with the sides of the drum 7 (when the platform comes, into contact with the platform stop bolt 17) the punch 1 is locked into place on the drum (FIG. 10). As can be appreciated, because the punch is remotely operated, it automatically secures itself to the drum. This reduces the risk of injury to the operator from manually securing the punch to the drum. At this point, upward movement of platform 13 is blocked by stops 17*a,b* and the platform 13 is unable to continue moving upwardly. It thus becomes a leverage point and the continued extension of piston rod 29 pushes punch point 49 and punch body 47 down through the top of drum 7 (FIG. 11) creating a hole in the drum top.

The punch head 45 continues to be pushed into the drum until the punch collar 51 comes in contact with drum top 67. Seal 65 seals the opening in the drum top created by the punch head 45. Because the seal is deformable, it will be deformed to conform to the surface of the drum top. Once the opening is sealed, the operator then stops the compressed air. If the collar is movable with respect to the punch head, the punch head can be inserted into the drum a distance sufficient for the bottom opening 55 to reach the drum contents. This will allow the head to be used with differing content levels, limited only by the length of the head.

By controlling the rate of flow of fluid through lines 35*a,b*, the speed of the puncturing operation can be controlled to reduce risk of sparking. Depending on the pressure used, the puncturing operation can be done in as little time as one second, or less, or in as long as one minute or more. The desired rate of puncturing the drum will depend in part on the drum condition, and its contents, if known.

With the punch inserted into the drum, gas may be vented through a exhaust bore 53 and couplings 59*a,b* to an analyzer or filter through a discharge hose 60. The exhaust bore and hose 60 allow for the drum to be depressurized and for the contents of the drum to be sampled. After the contents have been sampled, hose 60 may be used to introduce neutralizing agents (i.e. acids or bases if the contents are basic or acidic), gelling agents to solidify the contents, or other agents to treat the contents of the drum in a desired manner.

If one of the heads 45*b–e*, which have dual bores, are used, the head may be used to fully evacuate the drum. A hose 91 may be inserted through one of the bores to the bottom of the drum. Pressurized gas may then be introduced through the other bore to force the contents of the drum out of the drum through hose 91. In this manner, the drum can be emptied if it is too corroded to be moved with the contents therein. Alternatively, the hose 91 may be also be used to sample the contents of the drum, again using pressure introduced through the other bore, or to introduce neutralizing or solidifying agents into the drum to treat the contents of the drum while still in the drum.

The dual bore heads also allow for one bore to be connected to an injector which will introduce neutralizing agents, solidifying agents, etc. into the drum and for the other bore to be connected to a pump to sample and collect the contents of the drum. This allows for the sampling, treatment, and collecting of the drum contents without the need to change hoses or equipment. Other bores could be added so that the other testing or treating equipment can be placed in communication with the contents of the drum.

The dual bore can also be used to introduce an inert gas, such as nitrogen, into the drum. By introducing nitrogen, the pressure of the nitrogen can be used to force out residue of pressurized gas contained within the drum or to pump out the contents of the drum. In either case, a pressurized gas line would be connected to one of the bores, and an outlet line would be connected to the other bore. If a hose is inserted through the second bore to the bottom of the drum, the pressurized gas can be used to pump out the drum contents without the use of a mechanical pump. This is desirable where the drum contents can affect the drum. To eliminate gas which was not purged by the pressure of the drum when the drum was depressurized, the nitrogen gas, if heavier than the gas contained in the drum, can be pumped into the drum to force the gas out.

If the contents of the drum are determined to be safe, or are otherwise treated, and the drum is not too corroded, the punch may be used to move the drum. A crane, boom, or other lifting mechanism can be connected to ring 87 and, while the punch is secured to the drum, the crane can lift the punch/drum assembly to move the drum to a new location. The grip of the punch 1 is strong enough to hold upwards of 1000 lbs.

To remove the punch, air is vacated from the first line 35*a* and compressed air is forced into the second line 35*b* and into bottom actuation and retraction air inlet port 34 and lower pneumatic chamber 27. The compressed air forces piston 23 to move upward, pulling punch head 45 out of drum 7 and causing clamping arms 77*a* and 77*b* to release the drum 7. The device may then be removed from the drum.

Figure 12:
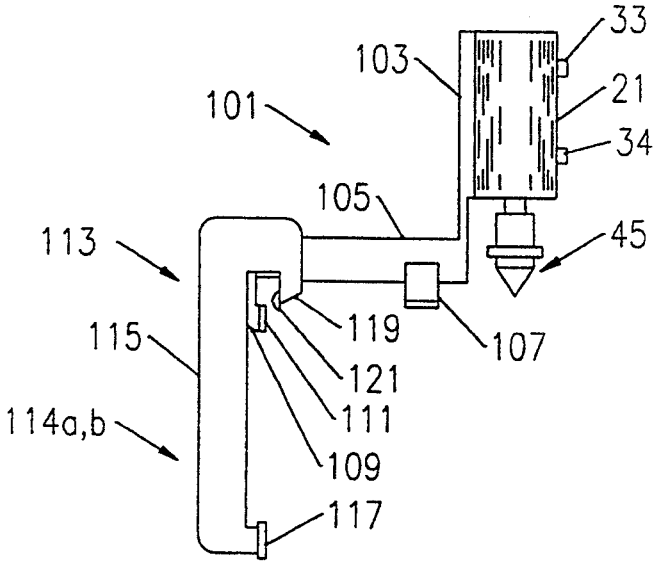
FIG. 12 is a side elevational view of an alternative embodiment of the drum punch.
Figure 13:
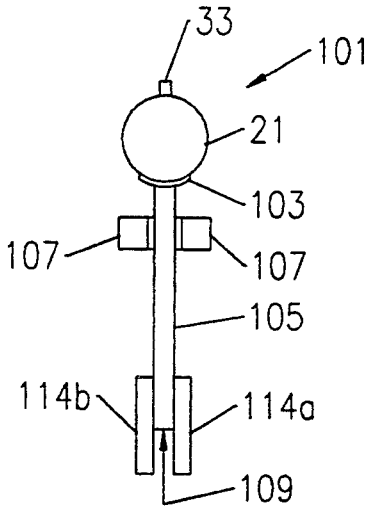
FIG. 13 is a top plan view of the drum punch of FIG. 12.
Figure 14:
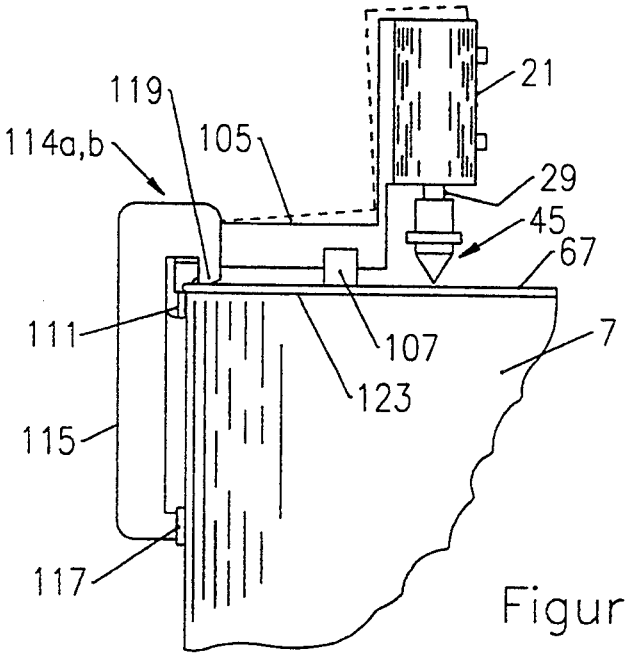
FIG. 14 is a side elevational view of the drum punch of FIG. 12 in place on a drum.

An alternate embodiment of the punch is shown in FIGS. 12–14. The drum punch 101 includes cylinder body 21 and punch head 45. The cylinder 21 is mounted to a vertical cylinder support 103. Support 103 has an inner surface which is shaped to substantially match the shape of cylinder 21. Support 103 is longer than cylinder 21 is tall and extends a distance beyond the bottom of cylinder 21 to accommodate the punch head 45. A horizontal arm 105 extends perpendicularly from the bottom of support 103. A stabilizer 107 extends downwardly from arm 105 a distance sufficient to contact the top of drum 46 when it is mounted thereon. Preferably there are two stabilizers 107 mounted to arm 105 on opposite sides thereof. The end of arm 105 is formed into a largely U-shaped projection 109 and includes an upper drum gripping pad 111.

A generally vertical clamping assembly 113 made of two identical members 114*a* and 114*b* is fixed to arm 105 near its end. Members 114*a,b* are generally C-shaped and include a vertical span 115 having an inwardly directed, lower drum gripping pad 117 at the bottom thereof. An outwardly directed rim grip 119 is formed at the top of span 115. Grip 119 has indentations 121 which connect or grip the rim 123 of drum 7. Grip 119 is spaced above and radially inwardly of pad 111 and faces pad 111. Arm 105 is connected to clamp members 114*a,b* so that it may pivot slightly with respect thereto. Arm 105 thus pivots between members 114*a,b* of vertical clamping assembly 113, as shown in phantom in FIG. 14.

To operate drum punch 101, it is initially placed on a drum such that arm 105 extends toward the center of the drum to position cylinder 21 and punch head 45 over the center of the drum. Punch 101 is positioned so that drum rim 123 is outside of rim catch indentations 121 and upper gripping pad 111 rests against the side of drum 7. At this point, the punch 101 is only resting on the drum and is not secured to the drum. Unlike punch 1, the punch head 45 of punch 101 is initially in contact with the top of the drum. Compressed gas is forced through top actuation and retraction air inlet port 33, causing piston rod 29 with punch head 45 to push downward. Because punch head 45 is in contact with drum top 67, motion is transferred to cylinder 21 and horizontal arm 105 to move cylinder 21 and arm 105 upwardly, as shown in phantom in FIG. 14. The upward motion of arm 105 pivots projection 109 and clamping assembly 113 about drum rim 123, causing upper drum gripping pad 111 and lower pad 117 to tightly grip the edge of drum. Punch 101 is then secured to drum 7 by the friction fit of indentations 121 against the inside of drum rim 123 and pads 111 and 117 against the side of drum 7. With the device locked in place, upward motion of cylinder 21 and horizontal arm 105 ceases. Motion is transferred to punch head 45, which is forced through the top of drum 46. As before, the downward motion of punch head 45 continues until collar 51 contacts the drum top and seal 65 seals the opening created by the punch head 45.

Figure 15:
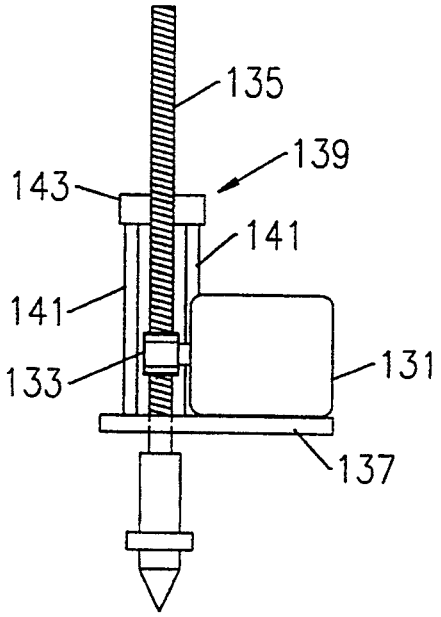
FIG. 15 is a side elevational view showing a gear-driven mechanism used to operate the drum punch.
Figure 16:
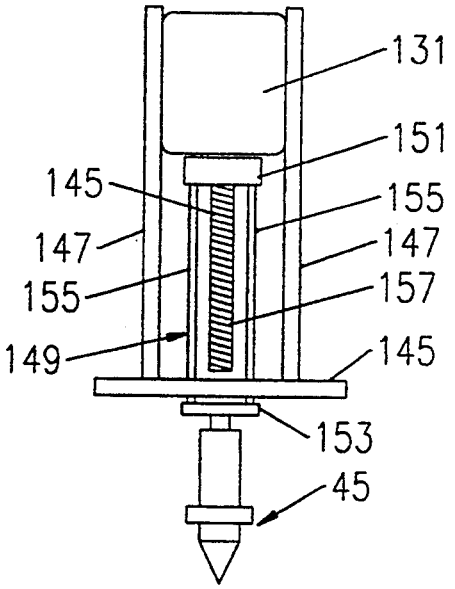
FIG. 16 is a side elevational view showing a rotating screw mechanism used to drive the drum punch.

In drum punches 1 and 101, the punch head 45 is driven by a hydraulically or pneumatically operated cylinder. Turning to FIGS. 15 and 16, the head can also be driven by a motor which produces a rotational output, such as an electric motor 131. In FIG. 15, motor 131 drives a gear 133 which interacts with a gear drive shaft 135 to force punch head 45 downward. Motor 131 is mounted on a platform 137 which is the equivalent of platform 13 of drum punch 1. A cage 139 has a pair of bars 141 extending upwardly from platform 137 and a top 143 which extends over the bars. Shaft 135 extends through cage top 143 and platform 137 and head 45 is located below platform 137.

In FIG. 16, electric motor 131 is supported above a platform 145 by a frame 147. Inside of frame 147, a cage 149 is mounted to platform 145 for vertical movement. Cage 149 includes top screw collar 151 and bottom collar 153 spaced apart by bars 155. Bars 155 slidably extend through platform 145 and collar 153 is located below platform 145 and collar 151 is located above platform 145. Head 45 is mounted to the bottom of collar 153. Motor 131 drives a screw 157 which extends at least through top screw collar 151. The rotational motion of screw 157 causes cage 149 to be moved downwardly, thereby moving punch head 45 downwardly.

As can be appreciated, the arms 75 and 77 are connected to the platform 137 in FIG. 15 and the platform 145 in FIG. 16. The operation of a punch using either of the drive configurations of FIGS. 15 or 16 would thus be substantially similar to that of drum punch 1.

Figure 17:
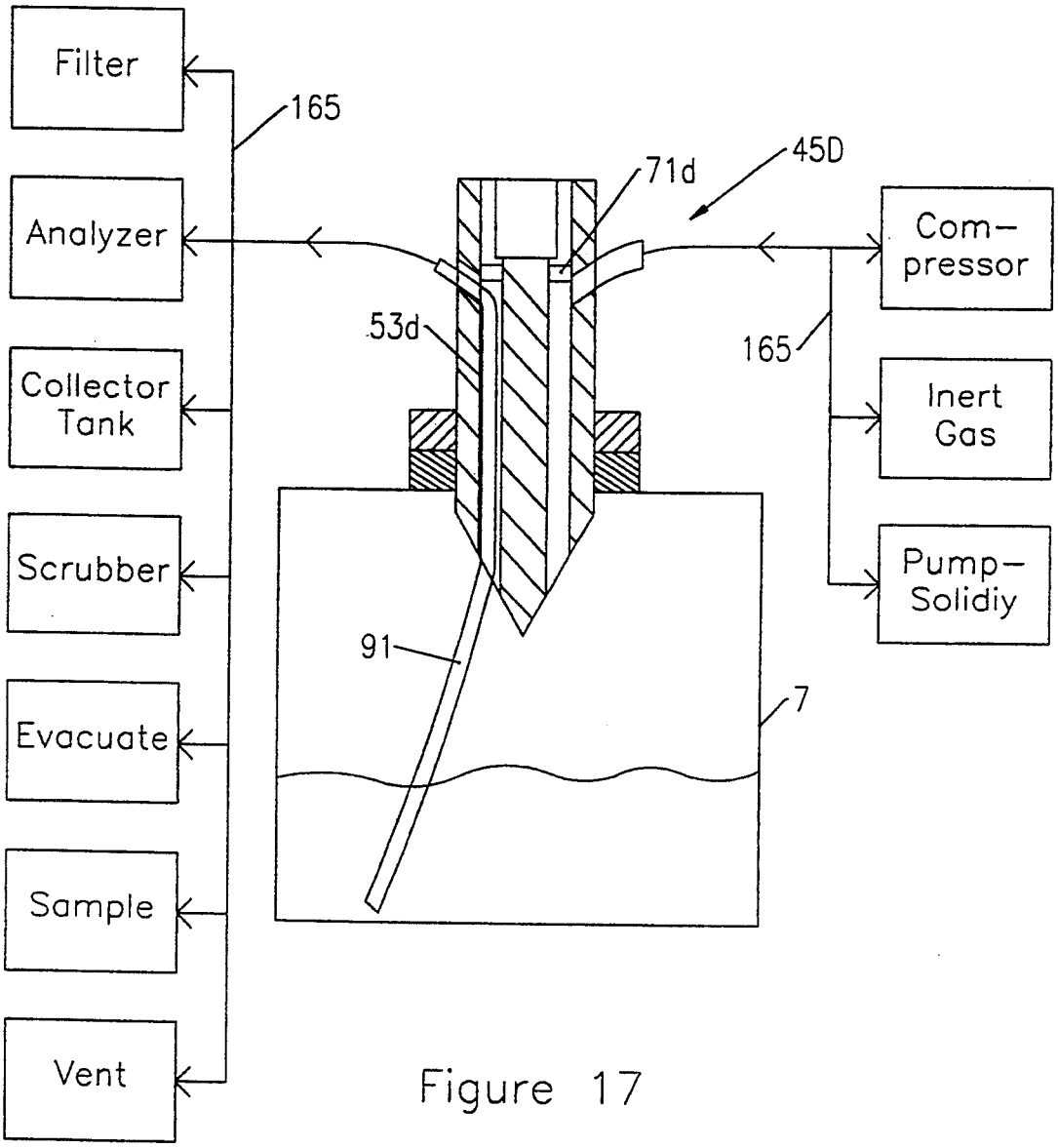
FIG. 17 is a schematic diagram of an optional manner of connecting the punch head to various pieces of equipment, such as analyzers, collectors, compressors, etc.

FIG. 17 shows the drum punch head 45 connected through tubing to an assortment of devices. One of the bores is connected to a compressor, a supply of inert gas, and a pump which supplies solidifying material. The other bore is connected via hose 91 to a filter, analyzer, collection tank, scrubber, evacuator, and sampler. These devices can be independently connected to the drum punch head and switched out as needed. Alternatively, and preferably, they can be connected via valve manifolds 165 which will allow switching between the various devices without the need to make new connections. This will reduce the possibility of any exposure of a worker to the contents of the tank.

While the above description contains many specificities, the reader should not construe these as limitations on the scope of the invention, but rather preferred embodiments thereof. Those skilled in the art may envision other possible variations within the scope of the apended claims. For instance, rather than using two sets of pivoting arms 75 and 77, and two struts 73, one set of pivoting arms can be provided and the other set of pivoting arms can be replaced with a fixed arm which extends down the side of the drum and has a clamp 83 which engages the side of the drum. The drum punch would then be positioned such that the fixed clamp is in contact with the side of the drum and the operation of the punch will move the pivotable arm to secure the drum punch to the drum. One set of additional holes 14*a–b* has been provided to facilitate use with different sizes of drums or bulged drums. The length of piston rod 29 or punch head 45 can be increased so that an evacuation port is positioned near the bottom of the drum. This will allow for evacuation of a drum which is so damaged that moving of the drum when full is dangerous. Accordingly, the reader is requested to determine the scope of the invention by the appended claims and their legal equivalents, and not by the examples which have been given.

I claim:

1. A method for remotely puncturing a top of a drum containing potentially hazardous waste with an apparatus having a clamp for gripping the drum and a punch head for piercing the drum, the clamp and punch head being actuated by a drive, the drive being operable remote from the drum, the method comprising the steps of:

placing the drum punch on the drum;

moving the punch head into contact with the drum by remotely operating the drive;

gripping the drum with the clamp by remotely operating the drive after the punch-head is in contact with the drum; and piercing the drum by remotely operating the drive after the drum is gripped.

2. The method of claim 1 further comprising the step of sealing the drum while the drum is pierced.

3. A drum punch comprising:

a punch head including a punch body, the punch body having opposite first and second ends with a puncturing point at the first end configured to pierce a top of a drum, the punch head further including a collar secured around the punch body, the collar including two opposite sides, one of the sides having means for sealing the collar against the drum top after the punch head has pierced the drum, the collar being adjustably positionable along the punch body between the first and second ends without extending beyond the first and second ends enabling the punch head to be inserted into the drum a desired distance defined by an adjusted position of the collar on the body.

4. The drum punch of claim 3 wherein the sealing means is made of a substantially deformable material.

5. The drum punch of claim 3 wherein the punch body includes a bore extending therethrough.

6. The drum punch of claim 5 wherein the bore includes first and second openings at opposite ends of the bore and positioned on the opposite sides of the collar.

7. The drum punch of claim 6 wherein the punch head includes a second bore extending therethrough, the second bore including first and second openings at opposite ends of the second bore and positioned on the opposite sides of the collar.

8. A remotely operable apparatus for puncturing a drum, the apparatus comprising:

a base having a configuration that enables the base to be set upon and rest stationary on the drum;

an elongated rod having a longitudinal length with opposite first and second ends;

a drive mounted on the base and operatively connected to the rod second end, the drive being selectively activated to move the rod longitudinally toward and away from the base and toward and away from the drum when the base is set upon the drum;

a punch head mounted on the rod first end, the punch head being configured to pierce the drum when the base is set upon the drum and the drive is activated to move the rod toward the base and the drum;

means on the base and operatively connected to the drive for securing the base to the drum when the base is set upon the drum and the drive is activated to move the rod toward the base and the drum; and means remote from the base and operatively connected to the drive for remotely activating the drive to selectively move the rod toward and away from the base and toward and away from the drum when the base is set upon the drum.

9. The apparatus of claim 8 wherein the drive is a piston and cylinder assembly and the rod is connected to the piston.

10. The apparatus of claim 8 wherein the rod has a screw collar at its second end and the screw collar has an internal screw threaded aperture therethrough, a shaft with external screw threads is screwed through the screw collar aperture, and the drive includes a motor connected to the shaft.

11. The apparatus of claim 8 wherein the rod has a rack of teeth formed thereon and the drive includes a motor and a gear driven by the motor, and the gear meshes with the rod rack of teeth.

12. The apparatus of claim 8 where the drum has an exterior surface and a top surface with a rim surrounding the top surface and joining the top surface to the exterior surface, the apparatus further comprising:

a base arm having a length with opposite first and second ends, the first end of the base arm being secured to the base and the second end of the base arm having a gripping pad thereon, the gripping pad being configured to extend over the drum rim and engage against the exterior surface of the drum when the base is set upon the top surface of the drum; and the means for securing the base to the drum includes a generally C-shaped clamp pivotally connected to the base arm distal end, the clamp having an upper gripping pad and a lower gripping pad at opposite ends of the clamp, the upper gripping pad being configured to engage against the rim over the drum top surface and the lower gripping pad being configured to engage against the exterior surface of the drum when the base is set upon the drum top surface, whereby the base arm gripping pad and the clamp upper gripping pad move toward each other gripping the drum rim therebetween in response to activating the drive to move the rod toward the base and the drum when the base is set upon the drum.

13. The apparatus of claim 8 further comprising a collar attached to the punch head and a gasket mounted on the collar, the gasket being configured to seal between the drum and the punch head when the punch head is inserted into the drum.

14. The apparatus of claim 13 wherein the gasket is made of a substantially deformable material.

15. The apparatus of claim 13 wherein the collar is configured to be positioned at any of a plurality of locations along the punch head, each of the plurality of locations defining a distance to which the punch head may be inserted into the drum.

16. The apparatus of claim 13 wherein the punch head includes a bore extending through the punch head, the bore having first and second openings at opposite ends of the bore and on opposite sides of the collar.

17. The apparatus of claim 16 further comprising a hose connected to the second opening.

18. The apparatus of claim 16 wherein the punch head includes a second bore extending therethrough.

19. The apparatus of claim 16 wherein a length of hose extends through the bore.

20. The apparatus of claim 8 wherein a slide is connected to the base and extends outwardly from the base and the drive is mounted on the slide for reciprocating sliding movement of the drive along the slide and relative to the base in response to the drive being activated to move the rod toward and away from the base.

21. The apparatus of claim 20 wherein the slide has opposite first and second ends, the slide first end is connected to the base and a stop is provided at the slide second end, the stop limiting sliding movement of the drive along the slide.

22. The apparatus of claim 21 further comprising:

a platform secured to the drive and mounted on the slide for reciprocating sliding movement of the platform and the drive along the slide;

a strut extending from the platform; and the means for securing the base to the drum when the base is set upon the drum includes a pivot arm having a length with opposite first and second ends, the first end of the pivot arm being pivotally connected to the strut, a clamp arm having a length with opposite first and second ends, the first end of the clamp arm being pivotally connected to the second end of the pivot arm, a clamp pad secured to the clamp arm second end, and a base arm projecting from the base to a distal end of the base arm, the base arm distal end being pivotally connected to the clamp arm intermediate the clamp arm first and second ends, whereby sliding movement of the platform along the slide from the slide first end toward the slide second end is transferred by the pivot arm to the clamp arm causing the clamp arm to pivot about the pivot connection of the base arm distal end to the clamp arm and thereby causes the clamp pad secured to the clamp arm second end to come into contact with the drum and secure the base to the drum when the base is set upon the drum.

23. The apparatus of claim 22 wherein:

a second strut extends from the platform; and the means for securing the base to the drum when the base is set upon the drum includes a second pivot arm having a length with opposite first and second ends, the first end of the second pivot arm being pivotally connected to the second strut, a second clamp arm having a length with opposite first and second ends, the first end of the second clamp arm being pivotally connected to the second end of the second pivot arm, a second clamp pad secured to the second clamp arm second end, and a second base arm projecting from the base to a distal end of the second base arm, the second base arm distal end being pivotally connected to the second clamp arm intermediate the second clamp arm first and second ends, whereby sliding movement of the platform along the slide from the slide first end toward the slide second end is transferred by the pivot arms to the clamp arms causing the clamp arms to pivot about the pivot connections of the base arm distal ends to the clamp arms and thereby causes the clamp arm pads secured to the clamp arm second ends to come into contact with the drum and secure the base to the drum when the base is set upon the drum.

* * * * *